US006882811B2

(12) United States Patent
Fukuda et al.

(10) Patent No.: US 6,882,811 B2
(45) Date of Patent: Apr. 19, 2005

(54) IMAGE DRUM CARTRIDGE AND DEVELOPING UNIT HAVING A MOVABLE DEVELOPING ROLLER

(75) Inventors: Masahiro Fukuda, Tokyo (JP); Shigeki Nakajima, Tokyo (JP); Atsushi Kobayashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 10/373,082

(22) Filed: Feb. 26, 2003

(65) Prior Publication Data

US 2003/0161655 A1 Aug. 28, 2003

(30) Foreign Application Priority Data

Feb. 28, 2002 (JP) ..... 2002-053679

(51) Int. Cl.[7] ..... G03G 21/18; G03G 15/08

(52) U.S. Cl. ..... 399/111; 399/279

(58) Field of Search ..... 399/111, 116, 399/117, 159, 222, 252, 274, 279, 284

(56) References Cited

U.S. PATENT DOCUMENTS 5,933,688 A * 8/1999 Suzuki et al. ..... 399/222
6,178,303 B1 * 1/2001 Ishii et al. ..... 399/279
6,577,831 B1 * 6/2003 Kojima et al. ..... 399/111

FOREIGN PATENT DOCUMENTS

| | | |
|---|---|---|
| JP | 07-056491 | 3/1995 |
| JP | 07-114266 | 5/1995 |
| JP | 09-034248 | 2/1997 |
| JP | 09-096937 | 4/1997 |
| JP | 2001-201939 | 7/2001 |
| JP | 2002-328525 | 11/2002 |

* cited by examiner

*Primary Examiner*—William J. Royer
(74) *Attorney, Agent, or Firm*—Rabin & Berdo, P.C.

(57) ABSTRACT

An image drum cartridge includes supporting walls, on which a photoconductive drum rotates, a position selector, a developing roller that rotates relative to the position selector, a developing blade that forms a thin layer of toner on the developing roller, and a slideable member that urges the developing blade against the developing roller. The position selector is mounted on the supporting walls and movable between first and second positions. The position selector causes the developing roller to move to an operative position where a nip is formed between the photoconductive drum and the developing roller. The position selector causes the developing roller to move to an inoperative position where no nip is formed between the photoconductive drum and the developing roller. The developing roller has a first rotational axis and the position selector has a second rotational axis away from the first rotational axis.

23 Claims, 19 Drawing Sheets

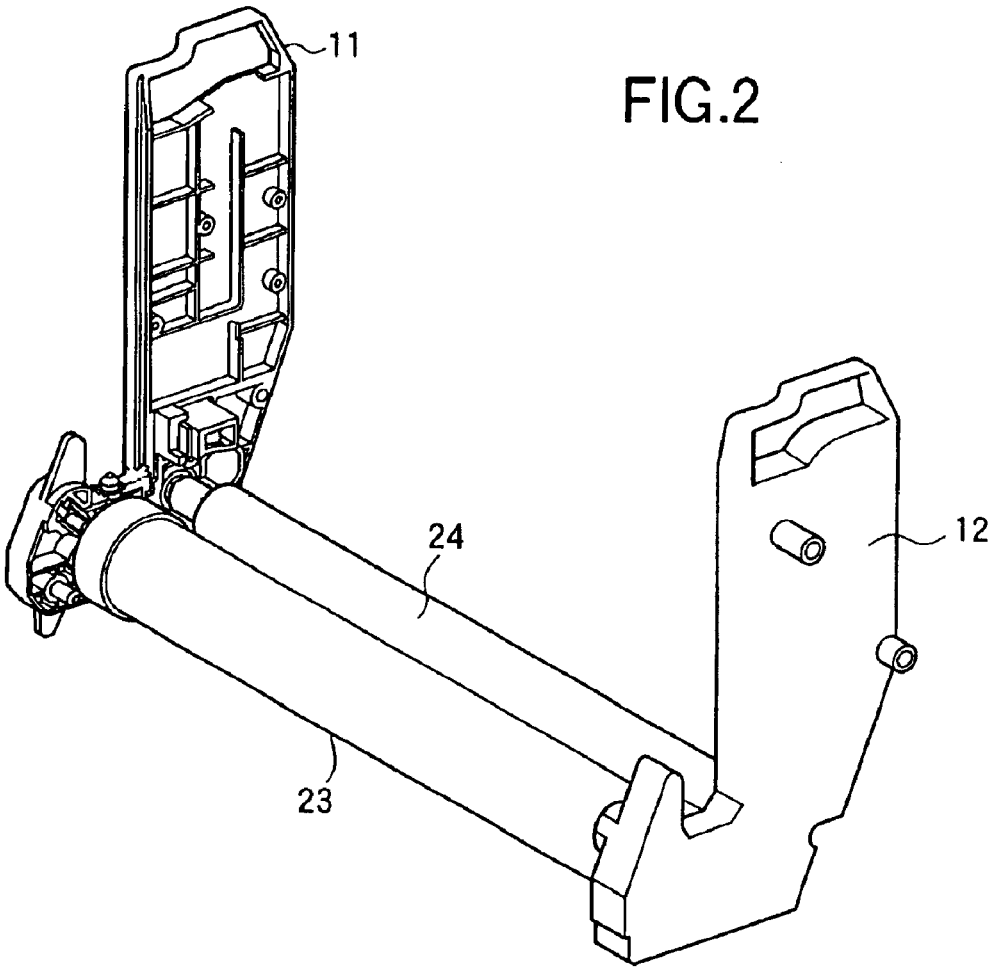
FIG.2
FIG.3
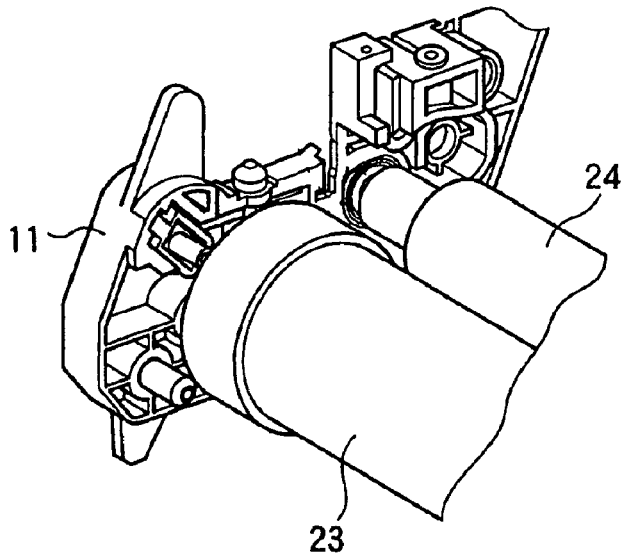

IMAGE DRUM CARTRIDGE AND DEVELOPING UNIT HAVING A MOVABLE DEVELOPING ROLLER

BACKGROUND OF THE INVENTION

1. Field of the Invention

The present invention generally relates to an image drum cartridge and a developing unit.

2. Description of the Related Art

A conventional image forming apparatus such as a printer, a facsimile machine, and a copying machine incorporates a photoconductive drum (i.e., image drum). There are provided a charging roller, an exposing unit, a developing roller, a transfer roller, and a cleaning roller in this order around the photoconductive drum. The charging roller charges the surface of the photoconductive drum uniformly. The exposing unit illuminates the charged surface to form an electrostatic latent image on the photoconductive drum. The developing roller applies toner to the electrostatic latent image to develop the electrostatic latent image into a toner image. The transfer roller transfers the toner image onto a recording medium. The recording medium having the toner image thereon passes through a fixing unit where the toner image is fused into a permanent image.

Structural elements such as the photoconductive drum, charging roller, developing roller, and cleaning roller have relatively short lives. Additionally, toner is a consumable item. Thus, a recent trend is that these structural elements including a toner cartridge are integrally assembled into a unitary construction, i.e., an image drum cartridge, so that the whole assembly can be quickly replaced for a new, unused one.

FIG. 25 illustrates the positional relationship between a photoconductive drum 23 and a developing roller 24 of a conventional art.

The rotational axes of the photoconductive drum 23 and the developing roller 24 are spaced apart by a predetermined distance in such a way that the developing roller 24 is in pressure contact with the photoconductive drum 23 to create a nip D between them.

With the conventional image forming apparatus, the nip D is present between the photoconductive drum 23 the developing roller 24 even when they are at rest. The presence of the nip D at all times causes a mark of the nip D to be left on the photoconductive drum 23 or causes the surface of the developing roller 24 to deform. Thus, when a print operation is performed after a long time storage of the apparatus, lines appear in a printed image, the lines extending in a direction in which the nip D extends.

SUMMARY OF THE INVENTION

The present invention solves the aforementioned problems of the conventional image forming apparatus. An object of the invention is to provide an image drum cartridge and developing unit where lines in the direction of a nip are eliminated and print quality is maintained.

An image drum cartridge includes a supporting member, an image drum, a bearing, and a rotative body. The image drum is rotatably supported on the supporting member. The bearing is mounted on the supporting member. The bearing is rotatable about a first rotational axis (sh2) relative to the supporting member and movable between a first position and a second position. The rotative body is rotatable about a second rotational axis (sh1) away from the first rotational axis (sh2). When the bearing rotates to the first position, the bearing causes the rotative body to move to an operative position where a nip is formed between the image drum and the rotative body. When the bearing rotates to the second position, the bearing causes the rotative body to move to an inoperative position where no nip is formed between the image drum and the rotative body.

The image drum cartridge further includes an operating member for operating the bearing, so that the bearing moves between the first position and the second position.

The operating member is detachably attached to the bearing.

When the operating member is attached to the image drum cartridge, the operating member causes the bearing to move to the second position. When the operating member is detached from the image drum cartridge, the operating member causes the bearing to move to the first position.

The image drum cartridge further includes a positioning member for selectively positioning the bearing at the first position and the second position.

A developing unit includes a bearing and a developing roller. The bearing is rotatable about a first rotational axis (sh2) relative to the supporting member and movable between a first position and a second position. The developing roller is rotatable about a second rotational axis (sh1) away from the first rotational axis (sh2). When the bearing rotates to the first position, the bearing causes the developing roller to move to an operative position. When the bearing rotates to the second position, the bearing causes the developing roller to move to an inoperative position.

The developing unit further includes a developing blade that is in contact with the developing roller when the developing roller is at the operative position. When the bearing moves from the first position to the second position, the developing roller moves in such a direction as to be away from the developing blade.

An image drum cartridge includes an image drum, a position-selecting member, and a developing roller. The position-selecting member is movable between a first position and a second position relative to the image drum. When the position-selecting member moves from the first position to the second position, the developing roller moves in such a direction as to be away from a developing blade. When the position-selecting member moves to the first position, the position-selecting member causes the developing roller to move to an operative position where the developing roller is out of engagement with the image drum and the developing blade. When the position-selecting member moves to the second position, the position-selecting member causes the developing roller to move to an inoperative position where the developing roller is in engagement with the image drum and the developing blade. When the developing roller is at the operative position, the developing roller rotating in contact with the developing blade.

The image drum cartridge further includes an operating member for operating the position-selecting member so that the position-selecting member moves between the first position and the second position.

The operating member is detachably attached to the position-selecting member.

When the operating member is pushed into the image drum cartridge, the operating member causes the position-selecting member to move to the second position. When the operating member is pulled out of the image drum cartridge, the operating member causes the position-selecting member to move to the first position.

The image drum cartridge further includes a supporting member on which the image drum is rotatably supported. The developing roller is rotatable about a first rotational axis (sh1) away from a second rotational axis (sh2). The position-selecting member is a bearing rotatable about a second rotational axis (sh2) relative to the supporting member.

The image drum cartridge further includes a positioning member for selectively positioning the bearing at the first position and the second position.

An image drum cartridge includes an image drum, a position-selecting member, a position-selecting member, an operating member, and a rotative body. The image drum is rotatably supported on a supporting member. The position-selecting member is mounted on the supporting member. The position-selecting member is movable between a first position and a second position relative to the supporting member. The operating member is attached to the image drum cartridge to operate the position-selecting member so that the position-selecting member moves between the first position and the second position. The operating member is detached from the image drum cartridge after operating the position selecting member. The rotative body is rotatable relative to the position-selecting member. When the position-selecting member moves to the first position, the position-selecting member causes the rotative body to move to an operative position where a nip is formed between the image drum and the rotative body. When the position-selecting member moves to the second position, the position-selecting member causes the rotative body to move to an inoperative position where no nip is formed between the image drum and the rotative body.

When the operating member is attached to the image drum cartridge, the operating member causes the position-selecting member to move to the second position (inoperative position). When the operating member is detached from the image drum cartridge, the operating member causes the position-selecting member to move to the first position (operative position).

An image drum cartridge includes a developing roller, a developing blade, and a slidable member. The developing blade has a first end portion at which the developing blade is fixedly supported and a second end portion at which the developing blade is movable to engage the developing roller. The slidable member slidably moves between an operative position and a non-operative position. When the slidable member moves to the operative position, the slidable member urges the second end of the developing blade against the developing roller. When the slidable member moves to the non-operative position, the slidable member does not urge the second end of the developing blade against the developing roller.

The slidable member is caused to move between the operative position and the non-operative position by a cam mechanism.

The image drum cartridge further includes an operating member that operates the slidable member to slide between the operative position and the non-operative position.

The operating member is attached to the image drum cartridge when the operating member operates the slidable member, and can be detached from the image drum cartridge when the operating member does not operate the slidable member.

A developing apparatus includes a developing roller, a developing blade, and a slidable member. The developing blade has a first end portion at which the developing blade is fixedly supported and a second end portion at which the developing blade is movable to engage the developing roller. The slidable member slidably moves between an operative position and a non-operative position. When the slidable member moves to the operative position, the slidable member urges the second end of the developing blade against the developing roller. When the slidable member moves to the non-operative position, the slidable member does not urge the second end of the developing blade against the developing roller.

The slidable member is caused to move between the operative position and the non-operative position by a cam mechanism.

The developing apparatus further includes an operating member that operates the slidable member to slide between the operative position and the non-operative position.

The operating member is attached to the image drum cartridge when the operating member operates the slidable member and can be detached from the image drum cartridge when the operating member does not operate the slidable member.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein:

FIG. 2 is a perspective view, illustrating a pertinent portion of an image drum cartridge;

FIG. 3 is an enlarged view of an image drum cartridge;

DETAILED DESCRIPTION OF THE INVENTION

First Embodiment

{Construction}

Figure 1:
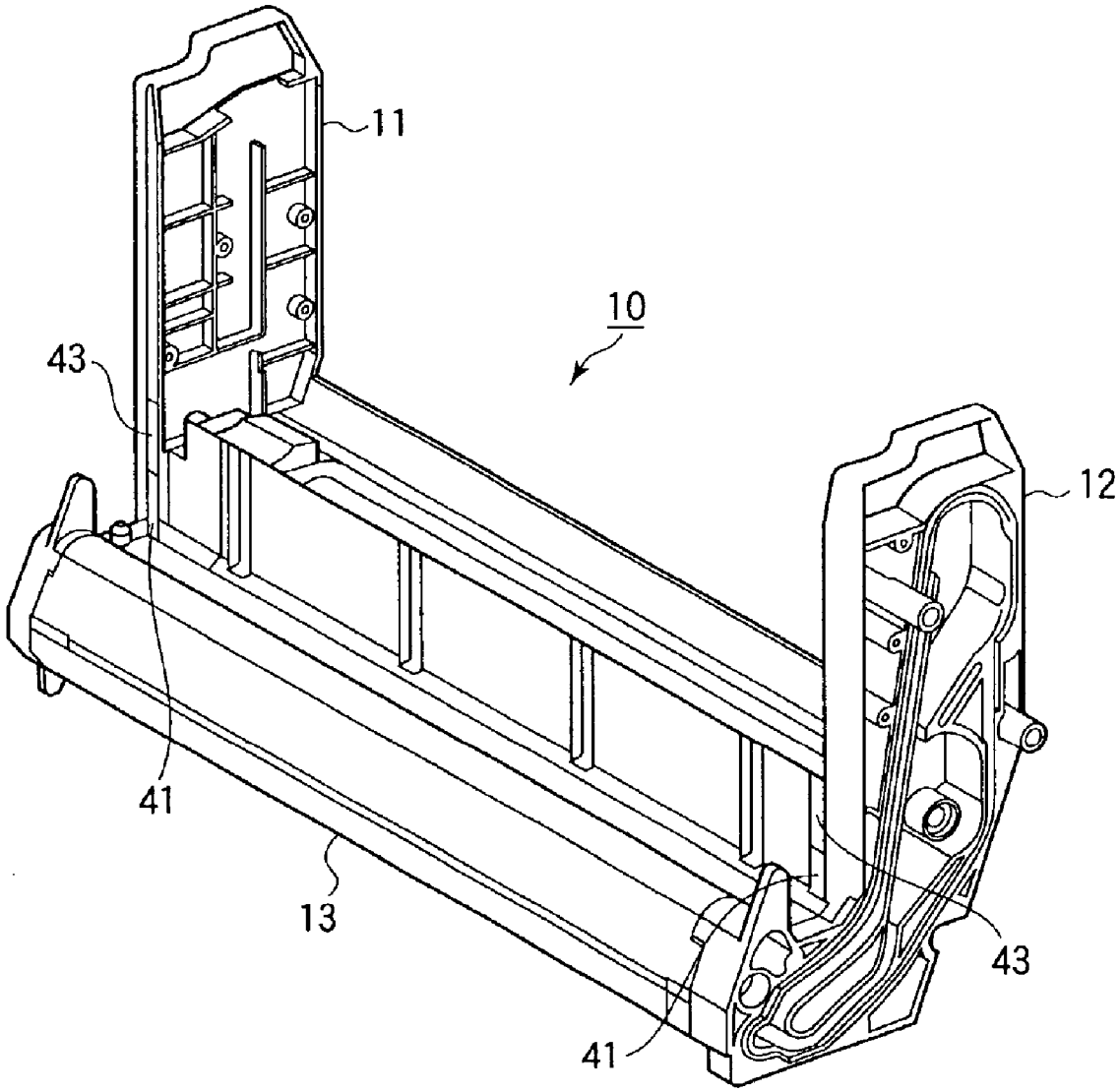
FIG. 1 is a perspective view of an image drum cartridge according to the first embodiment.

FIG. 1 is a perspective view of an image drum cartridge 10 according to a first embodiment.

Referring to FIG. 1, the image drum cartridge 10 includes a left side wall 11 and a right side wall 12 assembled integrally with a main body 13 between the left and right side walls 11 and 12. The main body 13 includes a photoconductive drum 23 (FIG. 2) and a charging roller, not shown. A transfer roller, not shown, is provided directly below the image drum cartridge 10. The charging roller charges the surface of the photoconductive drum 23 uniformly. An exposing unit, (LED head), not shown, illuminates the charged surface of the photoconductive drum 23 to form an electrostatic latent image. A developing roller 24 (FIG. 2) applies toner to the electrostatic latent image to form a toner image. The transfer roller transfers the toner image onto a recording medium. The recording medium having the toner image thereon is advanced to a fixing unit, not shown, where the toner image is fused into a permanent image.

FIG. 2 is a perspective view, illustrating a pertinent portion of the image drum cartridge 10.

FIG. 3 is an enlarged view of the image drum cartridge 10 in FIG. 2.

Figure 4:
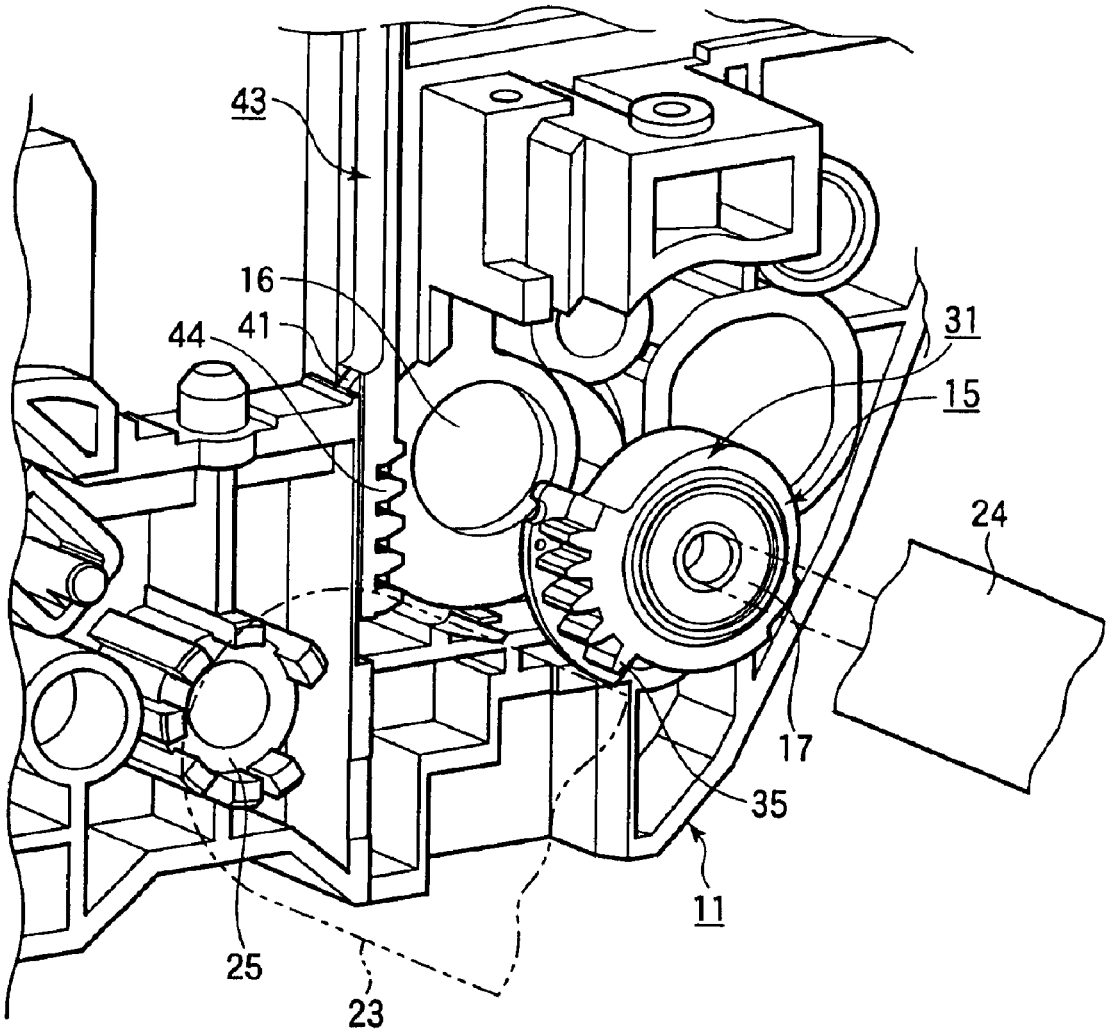
FIG. 4 is a perspective view, illustrating a bearing according to a first embodiment when the bearing is assembled to the apparatus.

Referring to FIGS. 2 and 3, there are provided the left side wall 11, the right side wall 12, the photoconductive drum 23, and the developing roller 24. The left and right side walls 11 and 12 also have holes 16 (FIG. 4) a predetermined distance away from projections 25 (FIG. 4). The holes 16 receive bearings 17 that support the developing roller 24.

FIG. 4 is a perspective view, illustrating a bearing 15 according to a first embodiment when the bearing 15 is assembled to the apparatus.

Referring to FIG. 4, each of the left and right side walls 11 and 12 is formed with the projection 25 and the hole 16 therein. The projection 25 and hole 16 are spaced apart a predetermined distance. A bearing 15 is rotatably received in each hole 16. The developing roller 24 is rotatably supported by means of bearings 17 disposed in the bearings 15 in such a way that the developing roller 24 is rotatable relative to the left and right side walls 11 and 12. The projections 25 project from surfaces of the left and right side walls 11 and 12 that oppose each other. The photoconductive drum 23 is also rotatably supported on the projections 25 by means of bearings.

A through-hole 41 is formed in each of the left and right side walls 11 and 12 between the projection 25 and the hole 16. The through-hole 41 receives an operating rod 43 inserted thereinto. The operating rod 43 is formed with a rack 44 in mesh with a gear 35. Moving the operating rod 43 vertically allows the bearing 15 to rotate.

Figure 5:
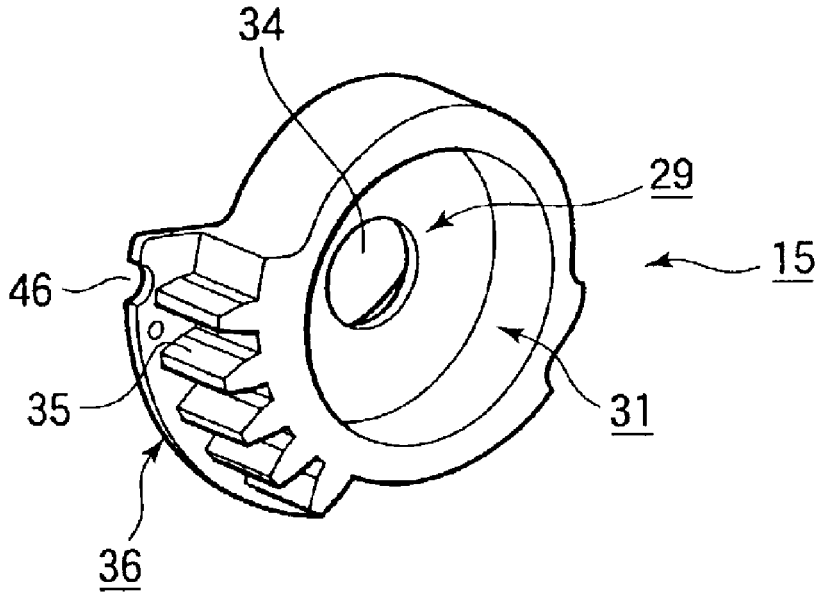
FIG. 5 is a front perspective view of the bearing.

FIG. 5 is a first perspective view of the bearing.

Figure 6:
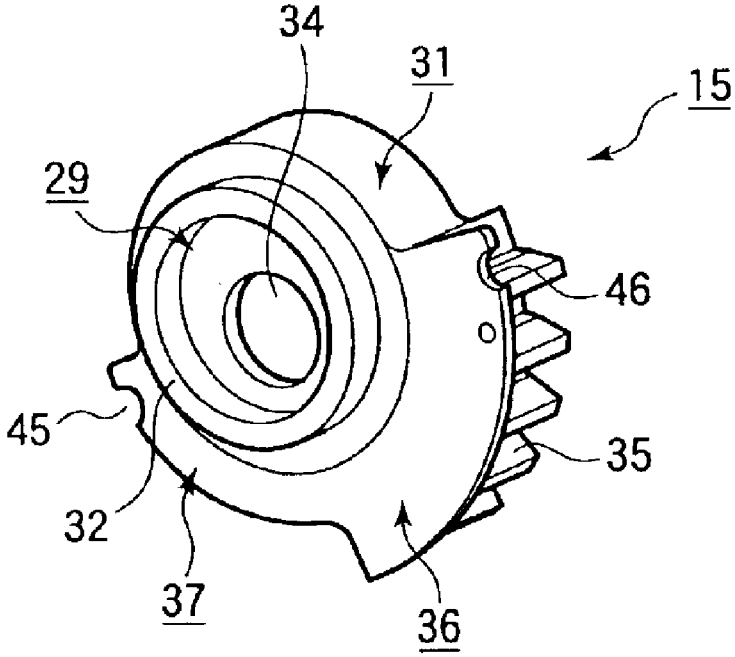
FIG. 6 is a second perspective view of the bearing.

FIG. 6 is a second perspective view of the bearing. Referring to FIGS. 5 and 6, the bearing 15 includes a substantially disk-like plate 29 and first and second cylindrical sleeves 31 and 32 that project from the disk-like plate 29 away from each other. Thus, the disk-like plate 29 closes the first and second cylindrical sleeves 31 and 32 at their one end. The second cylindrical sleeve 32 of the bearing 15 is fitted into the holes 16, so that the bearing 15 is rotatable with respect to the left and right side walls 11 and 12.

Figure 7:
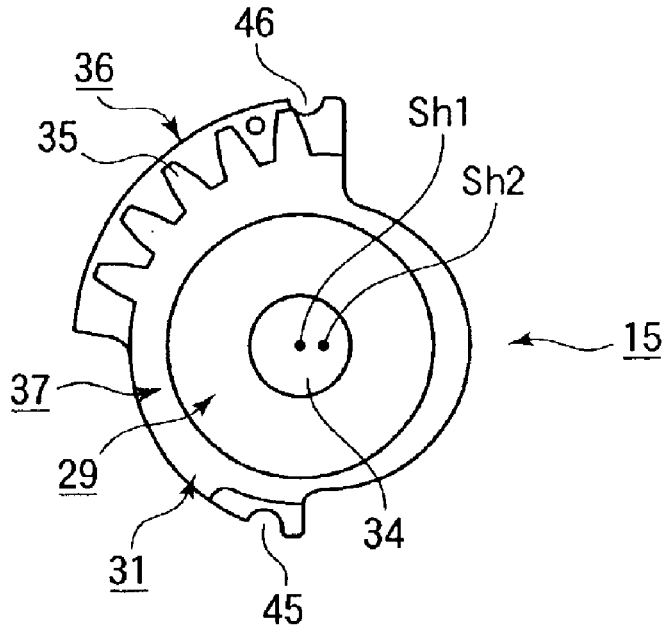
FIG. 7 is a first view of the bearing.

FIG. 7 is a front view of the bearing.

Figure 8:
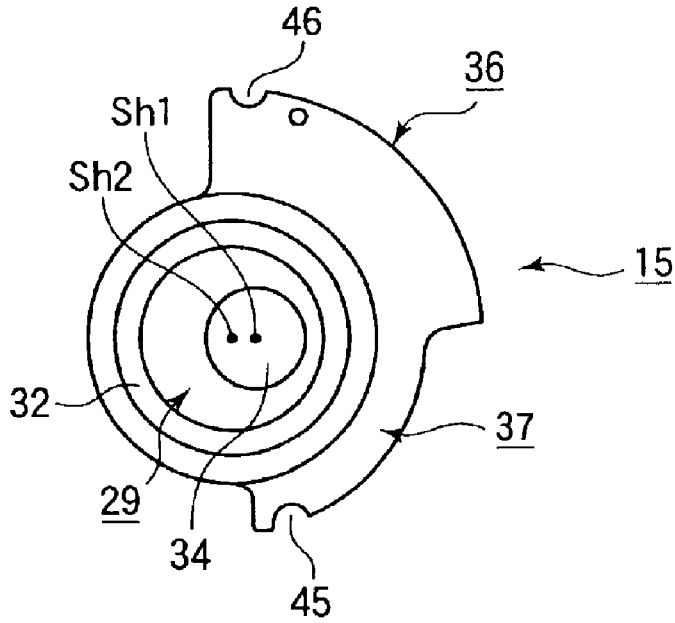
FIG. 8 is a rear view of the bearing.

FIG. 8 is a rear view of the bearing.

Referring to FIGS. 7 and 8, a first axis Sh1 and a second axis Sh2 are spaced apart by a predetermined distance, so that the first cylindrical sleeve 31 and the second cylindrical sleeve 32 are eccentric to each other. The disk-like plate 29 and the first cylindrical sleeve 31 form a space in which the bearing 17 is received. The first axis Sh1 serves as a rotational axis about which the developing roller 24 rotates. The second axis Sh2 serves as a rotational axis about which the bearing 15 rotates.

The disk-like plate 29 is formed with a through-hole 34 centered at the first axis Sh1. The first cylindrical sleeve 31 has a thick wall 37 that extends around the disk-like plate 29 circumferentially over about 180°. A gear 35 is formed in the outer circumferential surface of the thick wall 37, extending over about 90° on a circumference centered at the second axis Sh2. The gear 35 has an arcuate flange 36 that is centered at the second axis Sh2 and extends angularly across 90°. The thick wall 37 and the flange 36 have locking recesses 45 and 46 formed therein, respectively, for positioning the bearing 15 at a predetermined rotational position.

{Operation of Bearing}

The operation of the bearing 15 will be described.

Figure 9:
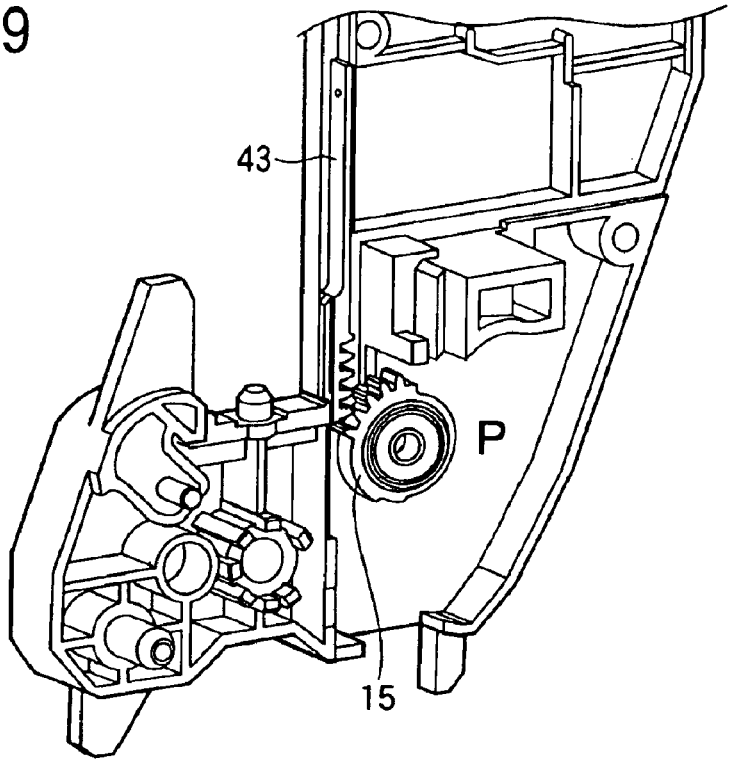
FIGS. 9–11 illustrate the operation of the bearing when an operating rod is operated.

FIG. 9 illustrates the bearing 15 when the operating rod 43 is moved to a position P.

Figure 10:
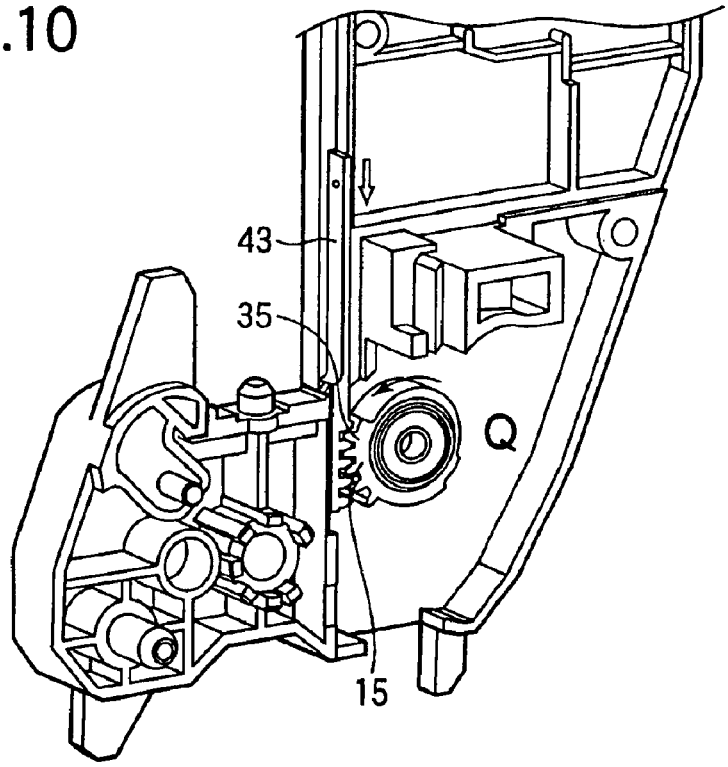

FIG. 10 illustrates the bearing 15 when the operating rod 43 is moved to a position Q.

Referring to FIGS. 9 and 10, the bearing 15 is in mesh with the rack 44 of the operating rod 43. When the operating rod 43 is moved vertically, the bearing 15 is rotated so that the bearing 15 can be positioned at a predetermined position. For example, moving the operating rod 43 in a direction shown by a white arrow in FIG. 10, the gear 35 rotates in a direction shown by an arrow to move to a position in FIG. 10.

Figure 11:
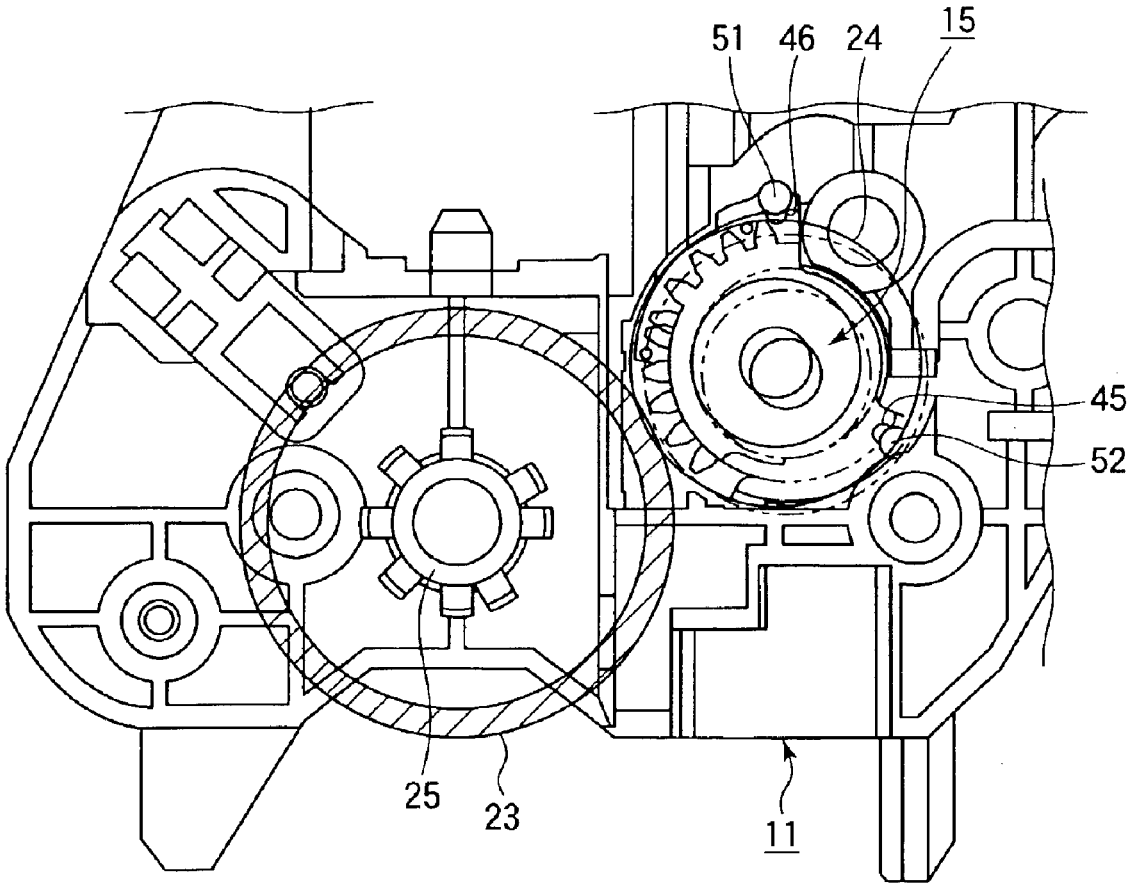

FIG. 11 illustrates the positional relationship between the photoconductive drum 23, bearing 15, and locking pins 51 and 52.

Figure 12A:
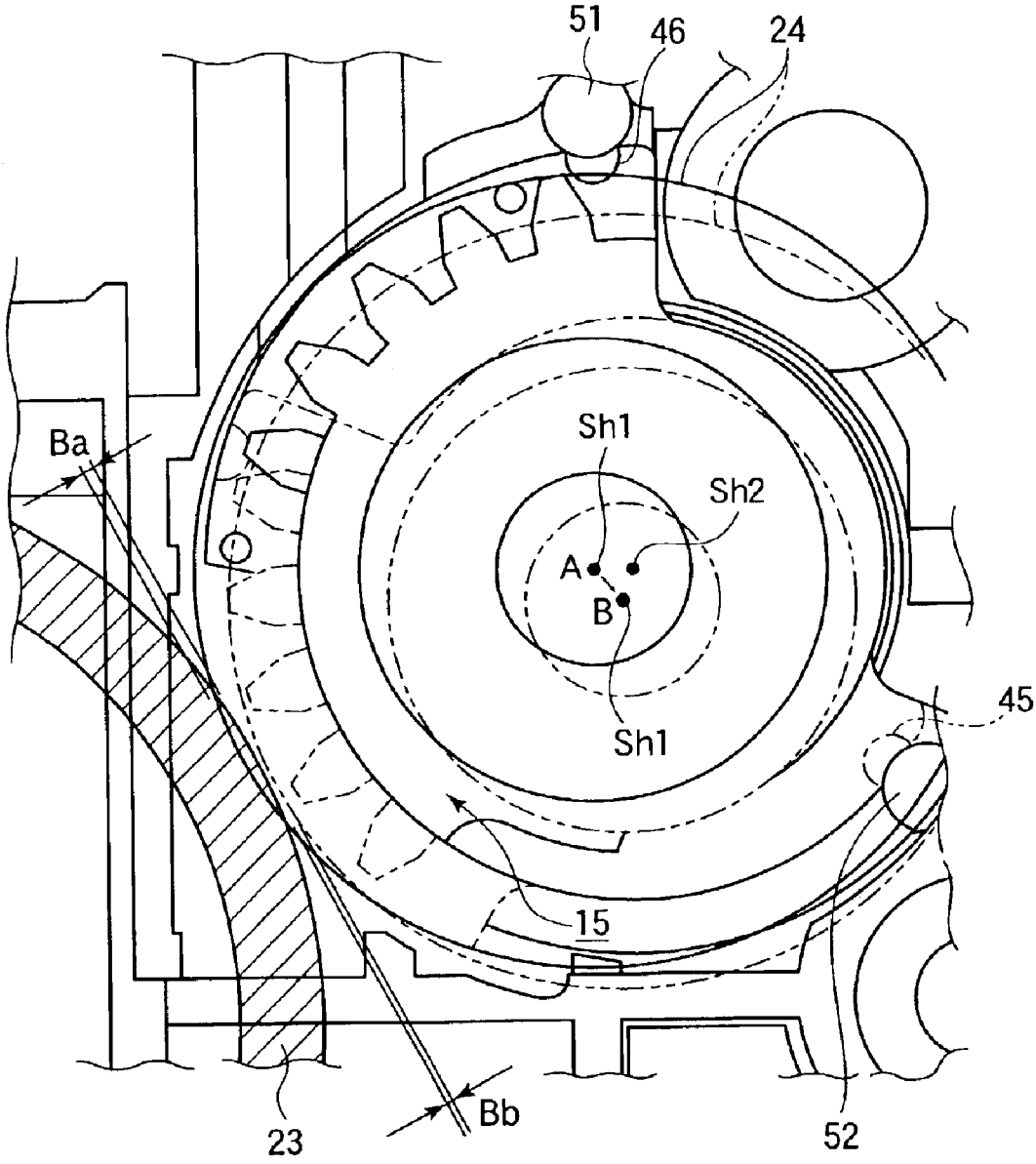
FIGS. 12A–12C are enlarged views, illustrating the operation of the bearing.

FIG. 12A is an enlarged view of FIG. 11.

Figure 12B:
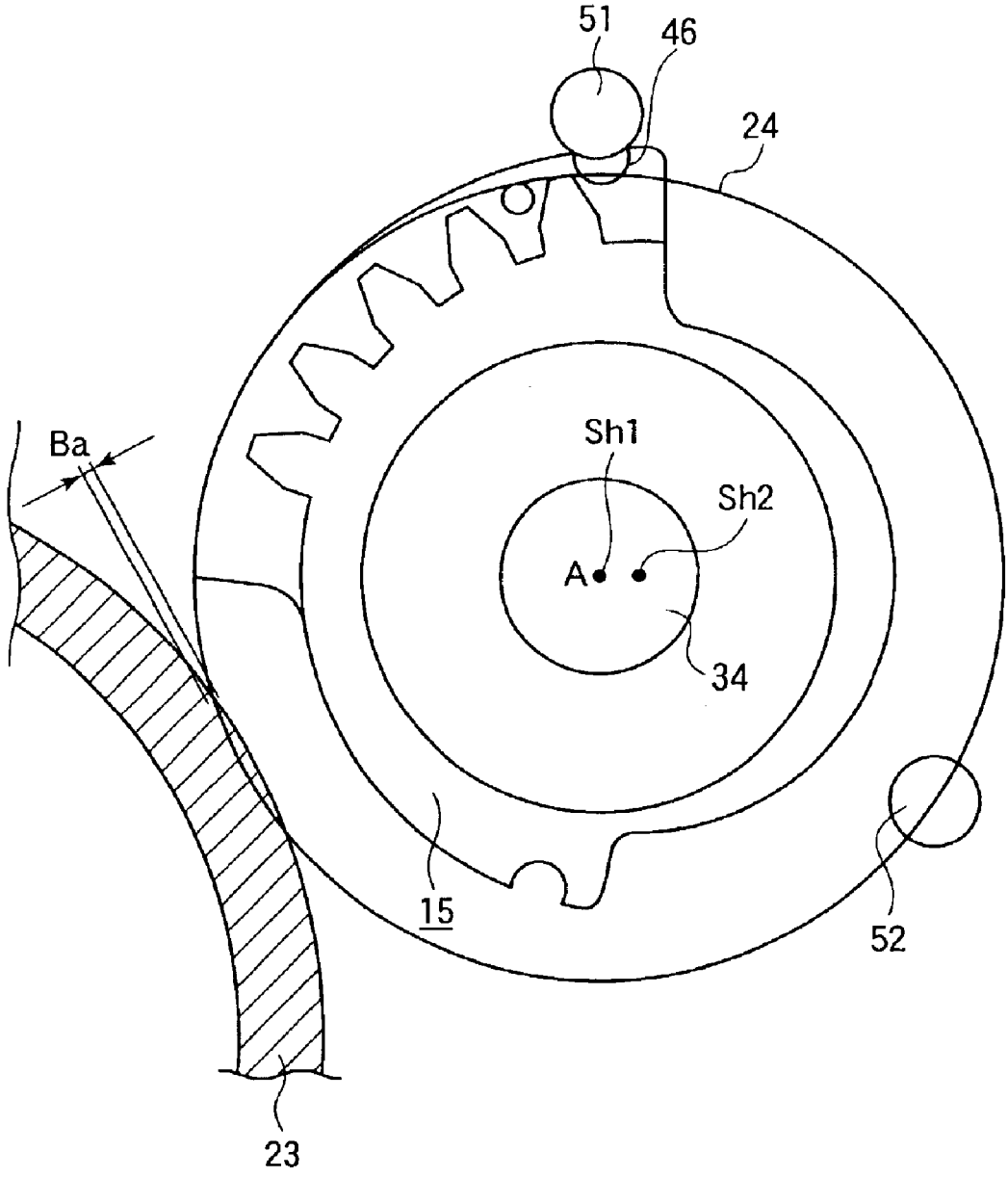
Figure 12C:
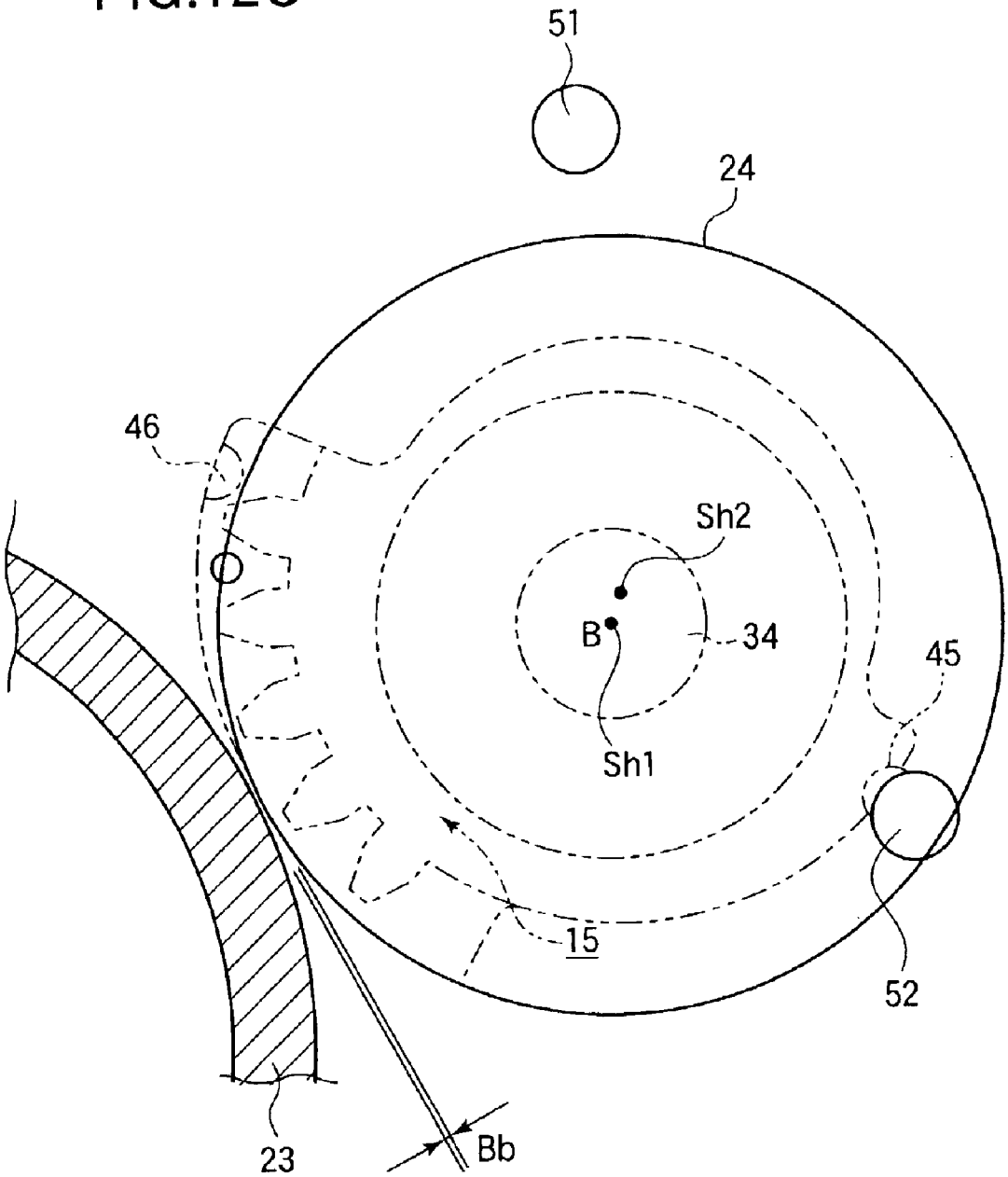

FIGS. 12B and 12C are enlarged views, illustrating the positional relationship between the bearing 15 and the photoconductive drum 23.

The second cylindrical sleeve 32 is centered at the second axis Sh2. When the second cylindrical sleeves 32 are fitted into the holes 16 formed in the left side wall 11 and right side wall 12, respectively, the bearings 15 are supported by the left side wall 11 and right side wall 12. Therefore, each bearing 15 rotates about the second axis Sh2.

Referring to FIG. 11, the left and right side walls 11 and 12 have locking pins 51 and 52 projecting therefrom. When the operating rod 43 in FIG. 9 is moved to a position P (FIG. 10), the bearing 15 rotates to a first adjustment position where the locking pin 51 drops in the locking recess 46 as shown in FIGS. 12A and 12B.

When the operating rod 43 is moved to a position Q (FIG. 9), the bearing 15 rotates to a second adjustment position where the locking pin 52 drops in the locking recess 45 as shown in FIGS. 12A and 12C.

As shown in FIG. 12B, when the bearing 15 rotates to the position P, the first axis Sh1 moves to a first axis position A. When the first axis Sh1 is at the first axis position A, the developing roller 24 is at its operative position, so that a nip having a size of Ba is created between the photoconductive drum 23 and the developing roller 24. When the bearing 15 rotates to the position Q, the first axis Sh1 moves to a second axis position B.

As shown in FIG. 12C, when the bearing 15 rotates to the position Q, the first axis Sh1 moves to the second axis position B. When the first axis Sh1 is at the second axis position B, the developing roller 24 is at its non-operative position where a gap having a size of Bb is formed between the photoconductive drum 23 and the developing roller 24. This operation brings the developing roller 24 to its non-operative position.

Figure 18A:
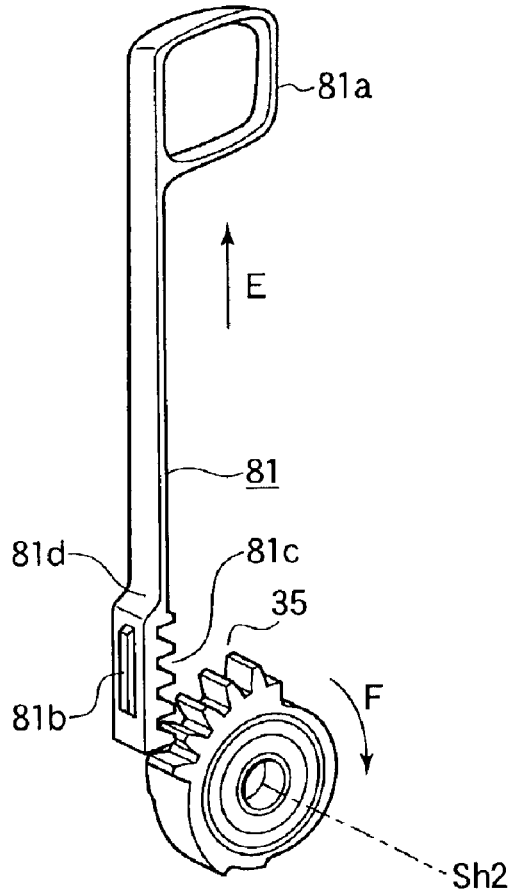
FIGS. 18A and 18B illustrate a modification to the operating rod.
Figure 18B:
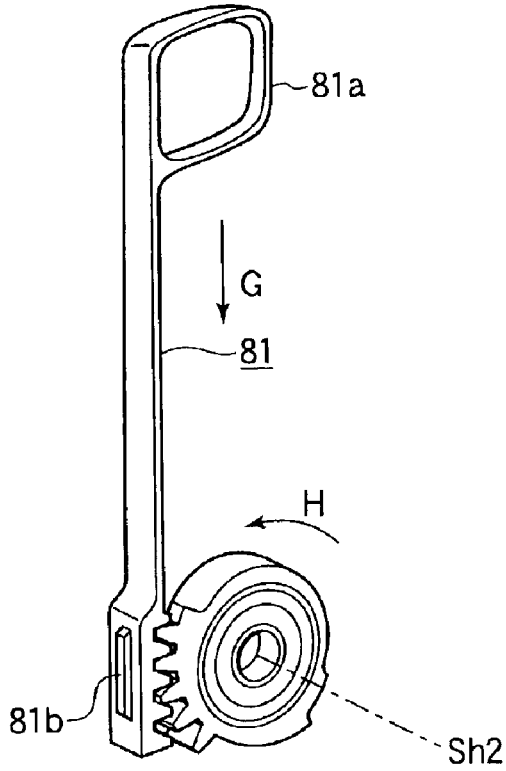

FIGS. 18A and 18B illustrate a modification to the operating rod 43.

An operating rod 81 is made of plastics and has a ring shaped finger hold 81*a* formed at one end portion, a rack 81*c* formed at another end portion, and a flexible straight portion between the finger hold 81*a* and the rack 81*c*. The operating rod 81 also has a guide 81*b* formed near the rack 81*c*, which is slidingly guided in a narrow groove formed in an inner surface of the through-hole 41 when the operating rod 81 is inserted into the groove.

Referring to FIG. 18A, when the image drum cartridge 10 is installed in the office, the operator can pull the finger hold 81*a* with his finger in a direction shown by arrow E. Thus, the rack 81*c* moves out of meshing engagement with the gear 35 to cause the gear 35 to rotate in a direction shown by arrow F. Thus, the developing roller 24 moves into pressing engagement with the photoconductive drum 23.

Referring to FIG. 18B, when the operating rod 81 is inserted into the through-hole 41, the operator pushes a portion 81*d* into the through-hole 41 in a direction shown by arrow G. Thus, the rack 81*c* moves into meshing engagement with the gear 35 to cause the gear 35 to rotate in a direction shown by arrow H. This causes the developing roller 24 to move out of engagement with the photoconductive drum 23.

Figure 13:
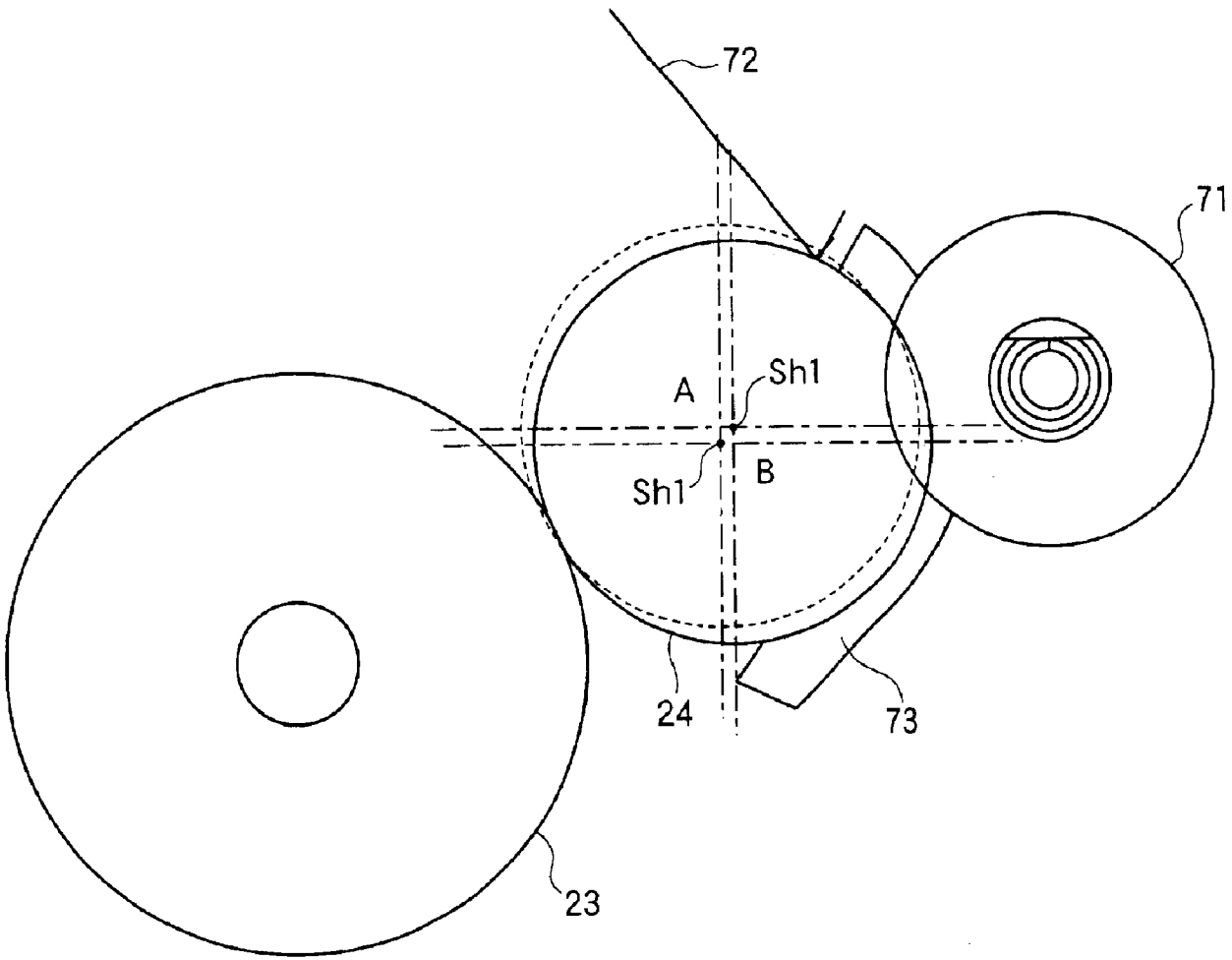
FIG. 13 illustrates the positional relationship between a photoconductive drum and a developing roller according to the first embodiment.

FIG. 13 illustrates the positional relationship between the photoconductive drum 23 and the developing roller 24 according to the first embodiment.

Referring to FIG. 13, a developing unit includes the developing roller 24, a toner supplying roller 71, and a developing blade 72. The developing roller 24 is a resilient body made of a synthetic rubber such as silicone and urethane and is in pressure contact with the photoconductive drum 23 to form a nip between the developing roller 24 and the photoconductive drum 23. The photoconductive drum 23 is a hollow cylindrical drum made of an aluminum alloy with a layer of a photoconductive material coated thereon. The toner-supplying roller 71 takes the form of a sponge roller and rotates in pressure contact with the developing roller 24 to supply toner, not shown, to the developing roller 24. The developing blade 72 is made of a thin metal plate such as a stainless plate bent into an L-shape. When the developing blade 72 is urged against the developing roller 24, the developing blade 72 is resiliently deformed to press the surface of the developing roller 24, thereby forming a thin layer of toner on the developing roller 24. A seal sponge 73 is disposed at each longitudinal end portion of the developing roller 24 so as to prevent the toner from spilling from the developing unit.

When the image drum cartridge 10 (FIG. 1) is not in operation, the developing roller 24 is moved to its non-operative position shown in a solid line in FIG. 13. When the image drum cartridge 10 is attached into the image forming apparatus, the developing roller 24 is moved to its operative position shown in a dotted line in FIG. 13.

When the first axis Sh1 moves in a direction parallel to a line tangent to the photoconductive drum 23, i.e., from the first axis position A to the second axis position B, the developing roller 24 is moved from the operative position (dotted line) to the non-operative position (solid line). In other words, as the bearing 15 moves from the position P (solid line in FIG. 12B) to the position Q (dot-dot-dash line in FIG. 12C), the developing roller 24 moves away from the photoconductive drum 23 and developing blade 72. Thus, the photoconductive drum 23 and the developing roller 24 are completely separated from each other. This operation prevents the surface of the developing roller 24 from remaining deformed by the photoconductive drum 23 and developing blade 72 when no printing is performed.

When the first axis Sh1 moves in a direction parallel to a line tangent to the photoconductive drum 23, i.e., from the second axis position B to the first axis position A, the developing roller 24 is moved from the non-operative position (solid line) to the operative position (dotted line). In other words, as the bearing 15 moves from the position Q to the position P, the developing roller 24 approaches the toner-supplying roller 71 so that the developing roller 24 presses the toner supplying roller 71 with a larger force. The toner-supplying roller 71 is made of a sponge material having a very low hardness. Therefore, the surface of the developing roller 24 is not deformed as the pressing force increases.

As described above, the developing roller 24 can be positioned selectively at the non-operative position and at the operative position. Therefore, when the developing roller 24 is at rest, no nip is formed between the photoconductive drum 23 and developing roller 24. This prevents the surface of the developing roller 24 from deforming or the mark of a nip from being left on the photoconductive drum 23 over time. The elimination of the mark of the nip and the deformation of the developing roller 24 prevents lines from resulting in printed images when printing is performed after a long-time storage of the apparatus. Thus, good print quality can be maintained.

Figure 19:
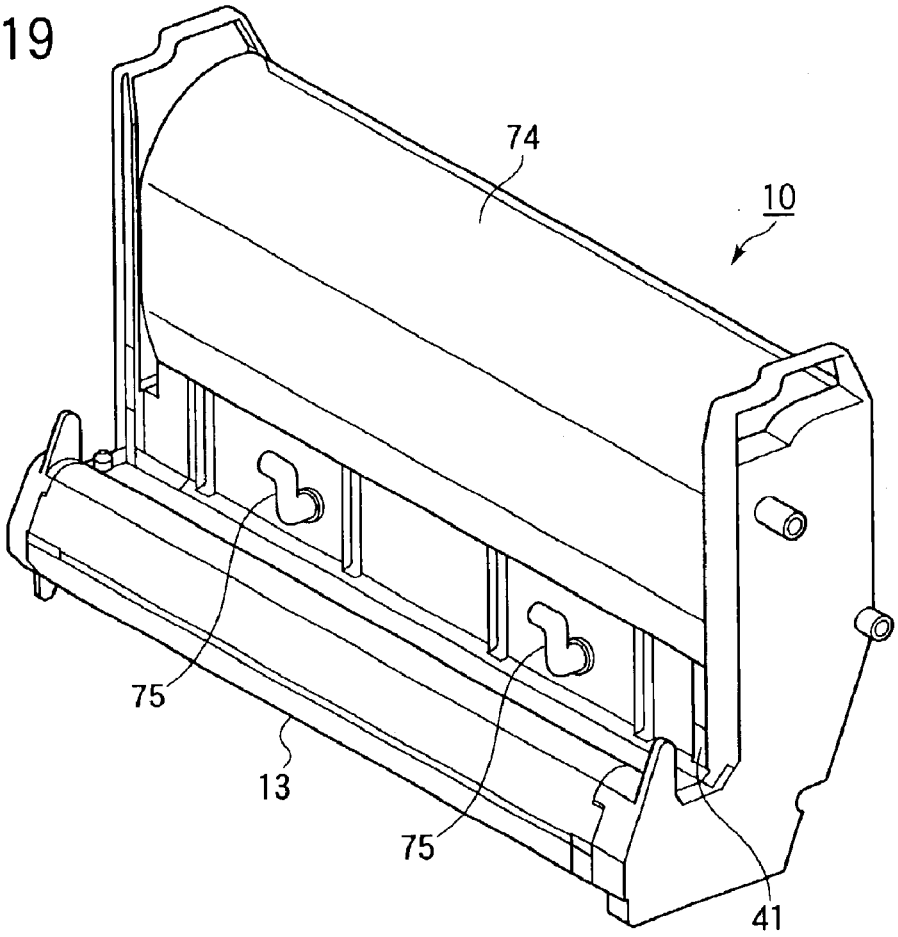
FIG. 19 illustrates a modification of the first embodiment that has a pressing mechanism for pressing a developing blade against the developing roller.

FIG. 19 illustrates a modification of the first embodiment that has a pressing member 77 for pressing a developing blade 79 against the developing roller 24.

Figure 20:
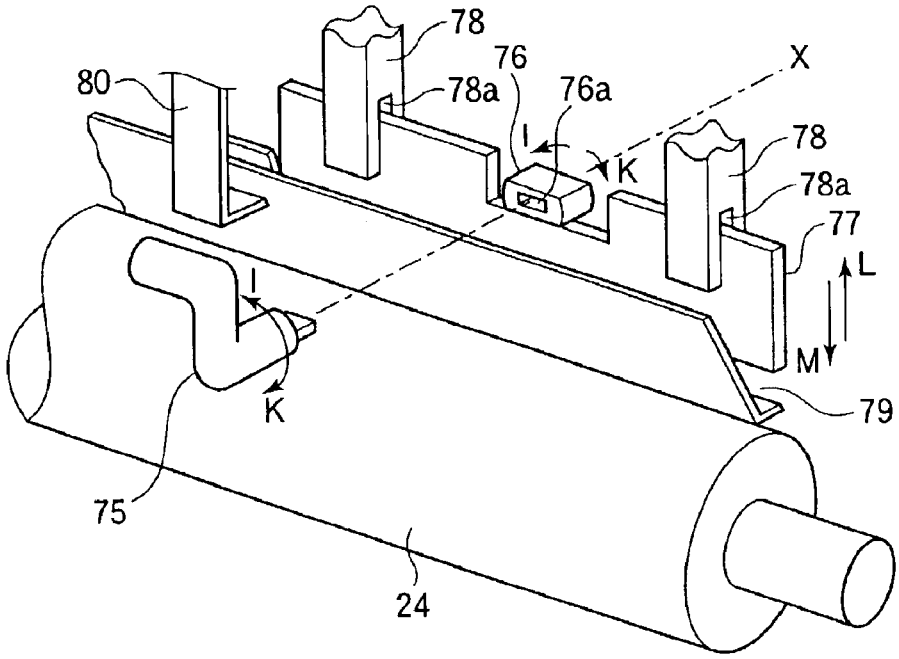
FIG. 20 illustrates the detail of the pressing mechanism.

FIG. 20 illustrates the detail of the pressing member 77.

Figure 21:
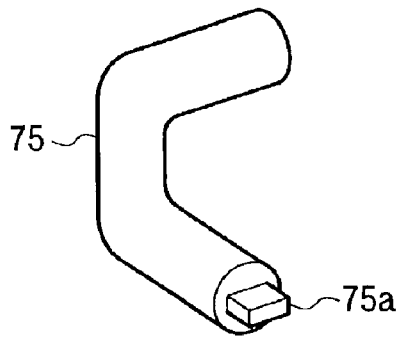
FIG. 21 is a perspective view, illustrating the detail of a handle.

FIG. 21 is a perspective view, illustrating the detail of a handle 75.

Referring to FIG. 19, an image drum cartridge 10 has a toner cartridge 74 attached to it. Referring to FIG. 20, a developing blade 79 is fixedly supported by a bracket 80 at a few locations. Guides 78 have slits 78*a* formed therein in which the pressing member 77 is slidably guided in directions shown by arrows L and M. The pressing member 77 is urged in the direction shown by arrow L by an urging means, not shown. The handle 75 has an engagement portion 75*a* that fits into an engagement hole 76*a* of a cam 76. Operating the handle 75 in directions shown by arrow K and I causes the cam 76 to slide in the L direction and M direction. The handle 75 can be detached from the cam 76 after operating the cam 76.

Figure 22A:
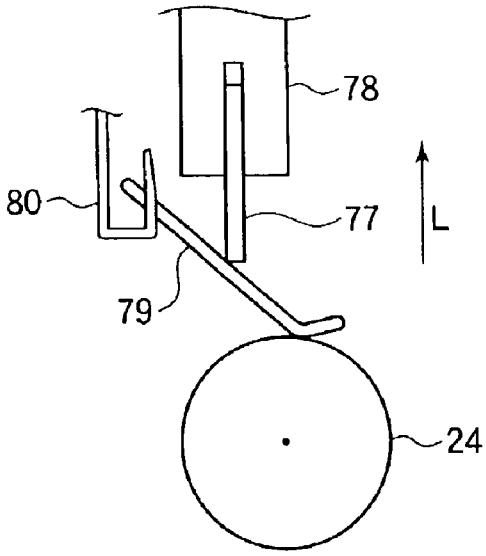
FIGS. 22A and 22B are side views, illustrating the pressing member and the developing blade.
Figure 22B:
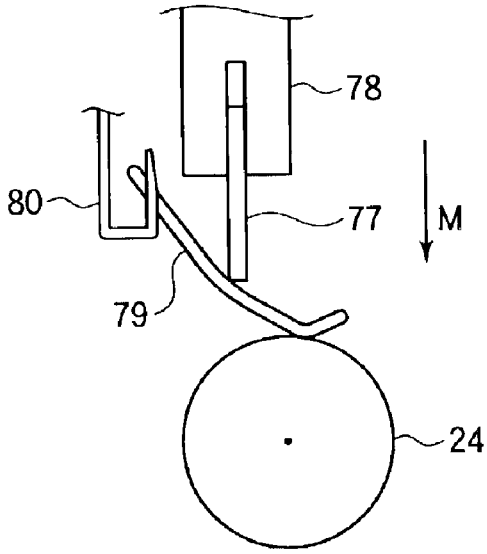

FIGS. 22A and 22B illustrate the positional relation between the pressing member 77 and the developing blade 79.

When the handle 75 is turned in a direction shown by arrow K by a 90° angle, the cam 76 rotates by a 90° angle in the direction shown by arrow K so that the pressing member 77 moves in the M direction. When the handle 75 is turned in a direction shown by arrow I by a 90° angle from a position shown in FIG. 20, the cam 76 rotates by a 90° angle in the direction shown by arrow I so that the pressing member 77 moves in the L direction.

FIGS. 22A and 22B are side views, illustrating pressing member 77 and the developing blade 79.

When the pressing member 77 moves in the L direction as shown in FIG. 22A, the pressing member 77 does not push the developing blade 79 so that the developing blade 79 does not deform to press the developing roller 24.

When the pressing member 77 moves in the M direction as shown in FIG. 22B, the pressing member 77 pushes the developing blade 79 so that the developing blade 79 resiliently deforms to press the developing roller 24.

Figure 23:
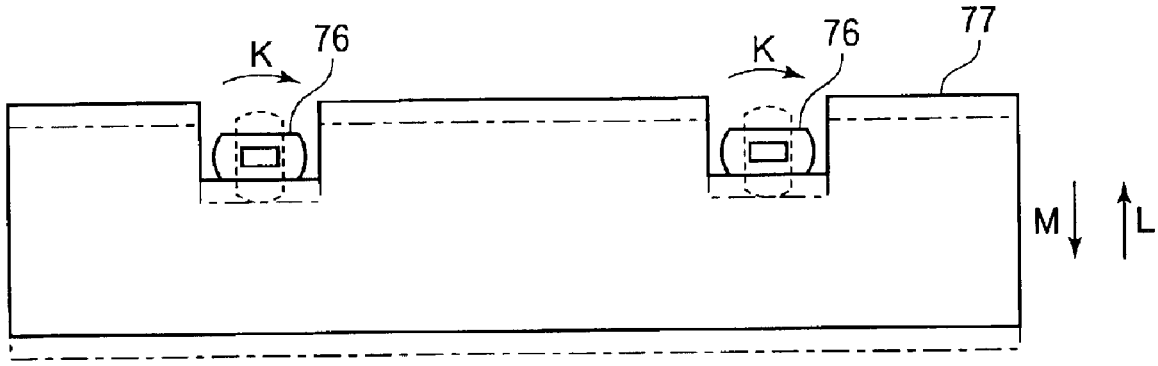
FIG. 23 is a front view of a cam and the pressing member.

FIG. 23 is a front view of the cam 76 and the pressing member 77.

Referring to FIG. 23, at least two cams 76 are provided. When the cams 76 are rotated by a 90° angle in the K direction, the cam 76 rotates in the K direction from the solid line position to the dotted line position, the pressing member 77 moves in the M direction to push the developing roller 24. When the cams 76 are rotated by a 90° angle in the opposite direction, the cam 76 rotates back in the opposite direction from the dotted line position to the solid line position, so that the pressing member 77 moves back in the L direction.

FIGS. 24A and 24B and FIGS. 24C and 24D illustrate modifications of the cam 76.

Figure 24A:
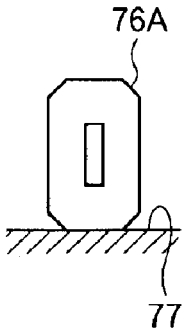
FIGS. 24A and 24B and FIGS. 24C and 24D illustrate modifications of the cam.
Figure 24B:
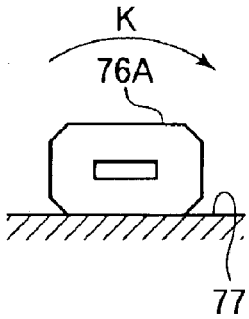

FIGS. 24A and 24B illustrate a cam 76A having flat portions that contact the pressing member 77. When the cam 76A in FIG. 24B is rotated by 90° in the K direction, the cam 76A stands on the pressing member 77 in a stable manner as shown in FIG. 24A.

Figure 24C:
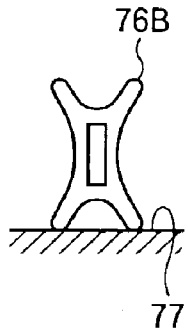
Figure 24D:
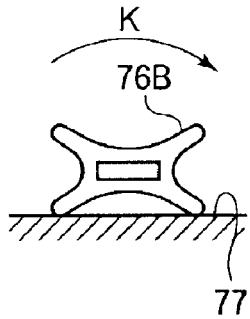
Figure 25:
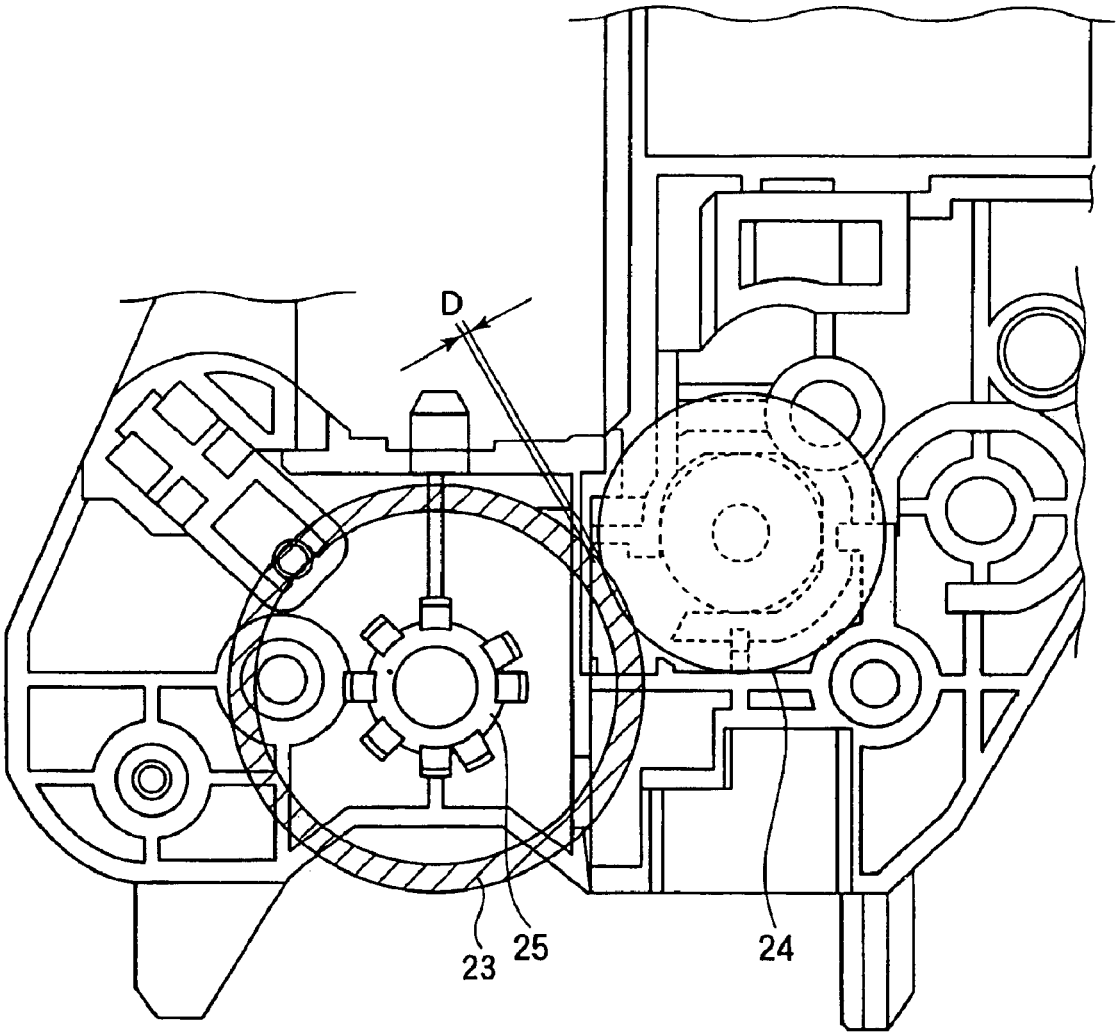
FIG.25 CONVENTIONAL ART
FIG. 25 illustrates the positional relationship between a photoconductive drum and a developing roller of a conventional art.

Referring to FIGS. 24C and 24D, a cam 76B has four projections so that the cam 76B can stand on the pressing member 77 in a stable manner in FIGS. 24C and 24D.

Second Embodiment

Figure 14:
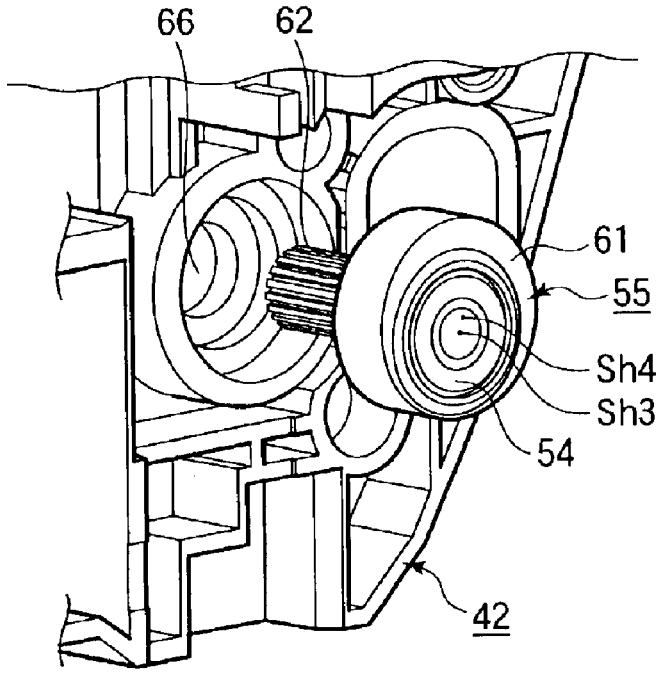
FIG. 14 is an exploded perspective view, illustrating a bearing according to a second embodiment.

FIG. 14 is an exploded perspective view, illustrating a bearing 55 according to a second embodiment.

Figure 15:
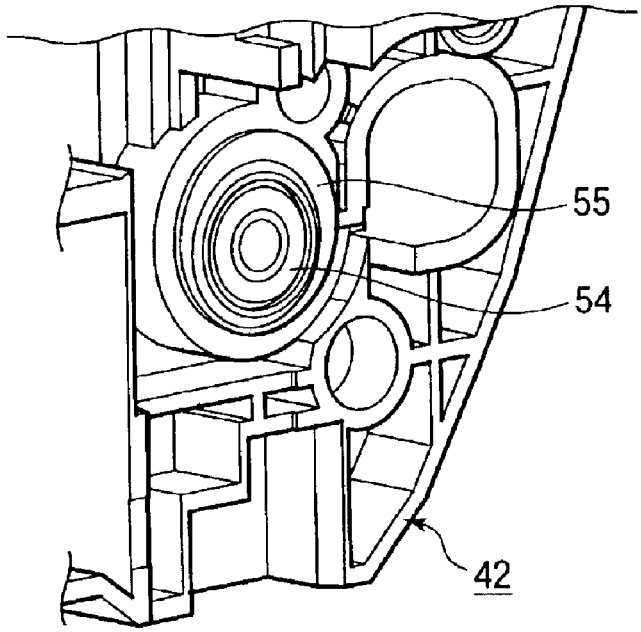
FIG. 15 is a perspective view, illustrating the bearing after it is assembled.

FIG. 15 is a perspective view, illustrating the bearing 55 after it is assembled.

Figure 16:
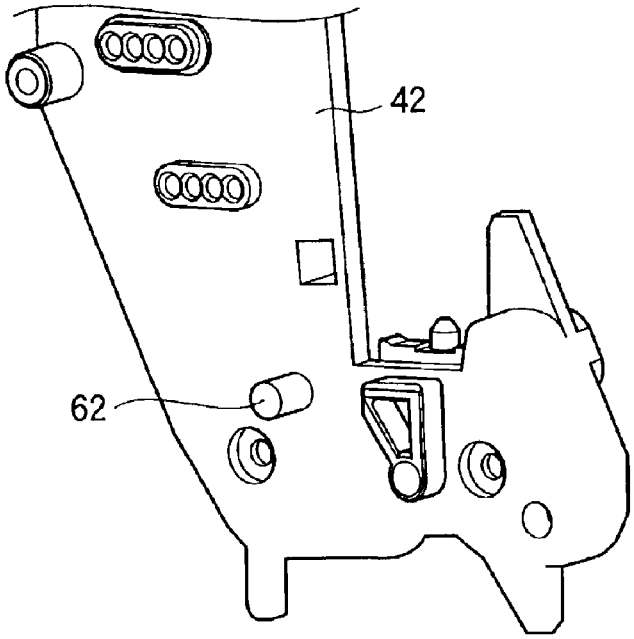
FIG. 16 is a perspective view, illustrating a left side wall according to the second embodiment.

FIG. 16 is a perspective view, illustrating a left side wall 42 according to the second embodiment.

Referring to FIGS. 14–16, the bearing 55 has a disk-like plate, not shown, a cylindrical space, a cylindrical receiving sleeve 61, and a cylindrical control 62. The cylindrical space is centered at a third axis Sh3. The cylindrical sleeve 61 is centered at a fourth axis Sh4 and projects forwardly from the disk-like plate. The cylindrical control 62 is also centered at the fourth axis Sh4 and projects rearwardly from the disk-like plate. The third and fourth axes Sh3 and Sh4 are defined a predetermined distance away from each other, so that the cylindrical control 62 is eccentric to the cylindrical space. The cylindrical space receives the bearing 54 therein. The developing roller 24 (FIG. 13) rotates about the third axis Sh3. In other words, the third axis Sh3 serves as an axis about which the developing roller 24 rotates while the fourth axis Sh4 serves as an axis about which the bearing 55 rotates.

The left side wall 42 and the right side wall (not shown) each have a hole 66 formed therein in which the bearing 55 is rotatably received. The cylindrical controls 62 extend through the holes 66 to the outer side of the left side wall 42 and the right side wall, respectively.

Figure 17:
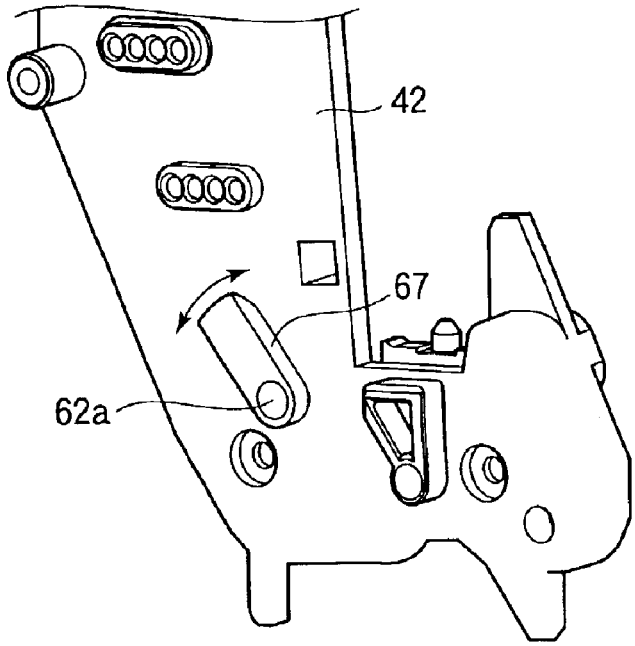
FIG. 17 is a perspective view, illustrating the bearing.

FIG. 17 is a perspective view, illustrating a lever 67.

As shown in FIG. 17, the lever 67 can be used in place of the cylindrical control 62, in which case a shaft 62*a* in line with the fourth axis Sh4 projects through the hole 66 from the left side wall 42 and the lever 67 is attached to the shaft 62*a*.

The use of the lever 67 facilitates adjustment of rotation of the bearing 55.

The bearing 55 can be rotated by a variety of means. A wire may be wound on the bearing 55 and pulled to rotate the bearing 55. Alternatively, a friction member may be attached to the bearing 55 and moved straight or rotated, thereby causing the bearing 55 to rotate.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. An image drum cartridge comprising:

a supporting member;

an image drum rotatably supported on said supporting member;

a bearing mounted on said supporting member, said bearing being rotatable about a first rotational axis relative to said supporting member and movable between a first position and a second position; and a rotative body rotatable about a second rotational axis away from the first rotational axis, wherein when said bearing rotates to the first position, said bearing causes said rotative body to move to an operative position where a nip is formed between said image drum and said rotative body, and when said bearing rotates to the second position, said bearing causes said rotative body to move to an inoperative position where no nip is formed between said image drum and said rotative body.

2. The image drum cartridge according to claim 1, further comprising an operating member for operating said bearing so that said bearing moves between the first position and the second position.

3. The image drum cartridge according to claim 2, wherein the operating member is detachably attached to said bearing.

4. The image drum cartridge according to claim 3, wherein when the operating member is attached to the image drum cartridge, the operating member causes said bearing to move to the second position, and when the operating member is detached from the image drum cartridge, the operating member causes said bearing to move to the first position.

5. The image drum cartridge according to claim 1, further comprising a positioning member for selectively positioning the bearing at the first position and the second position.

6. A developing unit comprising:

a bearing rotatable about a first rotational axis and movable between a first position and a second position; and a developing roller rotatable about a second rotational axis away from the first rotational axis, wherein when said bearing rotates to the first position, said bearing causes said developing roller to move to an operative position, and when said bearing rotates to the second position, said bearing causes said developing roller to move to an inoperative position.

7. The developing unit according to claim 6, further comprising a developing blade that is in contact with said developing roller when said developing roller is at the operative position, wherein when said bearing moves from the first position to the second position, said developing roller moves in such a direction as to be away from the developing blade.

8. An image drum cartridge comprising:

an image drum;

a position-selecting member movable between a first position and a second position relative to said image drum;

a developing roller; and a developing blade, wherein when said position-selecting member moves to the first position, said position-selecting member causes said developing roller to move to an operative position where said developing roller is in engagement with said image drum and said developing blade, and when said position-selecting member moves to the second position, said position-selecting member causes said developing roller to move to an inoperative position where said developing roller is out of engagement with said image drum and said developing blade, wherein when said developing roller is at the operative position, said developing roller rotates in contact with said developing blade.

9. The image drum cartridge according to claim 8, further comprising an operating member for operating said position-selecting member so that said position-selecting member moves between the first position and the second position.

10. The image drum cartridge according to claim 9, wherein the operating member is detachably attached to said position-selecting member.

11. The image drum cartridge according to claim 9, wherein when the operating member is pushed into the image drum cartridge, the operating member causes said position-selecting member to move to the second position, and when the operating member is pulled out of the image drum cartridge, the operating member causes said position-selecting member to move to the first position.

12. The image drum cartridge according to claim 8, further comprising a supporting member on which said image drum is rotatably supported, wherein said developing roller is rotatable about a first rotational axis away from a second rotational axis;

wherein said position-selecting member is a bearing rotatable about a second rotational axis relative to said supporting member.

13. The image drum cartridge according to claim 12, further comprising positioning members for selectively positioning the bearing at the first position and the second position.

14. An image drum cartridge comprising:

an image drum rotatably supported on a supporting member;

a position-selecting member mounted on said supporting member, said position-selecting member being movable between a first position and a second position relative to said supporting member;

an operating member that operates said position-selecting member so that said position-selecting member moves between the first position and the second position, said operating member being attached to the image drum cartridge to operate said position selecting member and detached from the image drum cartridge after operating said position-selecting member; and a rotative body rotatable relative to said position-selecting member, wherein when said position-selecting member moves to the first position, said position-selecting member causes said rotative body to move to an operative position where a nip is formed between said image drum and said rotative body, and when said position-selecting member moves to the second position, said position-selecting member causes said rotative body to move to an inoperative position where no nip is formed between said image drum and said rotative body.

15. The image drum cartridge according to claim 14, wherein when the operating member is attached to the image drum cartridge, the operating member causes said position-selecting member to move to the second position;

wherein when the operating member is detached from the image drum cartridge, the operating member causes said position-selecting member to move to the first position.

16. An image drum cartridge, comprising:

a developing roller;

a developing blade having a first end portion at which said developing blade is fixedly supported and a second end portion at which said developing blade is movable to engage said developing roller; and a slidable member that slidably moves between an operative position and a non-operative position, wherein when said slidable member moves to the operative position, said slidable member urges the second end of said developing blade against said developing roller, and when said slidable member moves to the non-operative position, said slidable member does not urge the second end of said developing blade against said developing roller.

17. The image drum cartridge according to claim 16, wherein said slidable member is caused to move between the operative position and the non-operative position by a cam mechanism.

18. The image drum cartridge according to claim 16, further comprising an operating member that operates said slidable member to slide between the operative position and the non-operative position.

19. The image drum cartridge according to claim 18, wherein the operating member is attached to the image drum cartridge when the operating member operates said slidable member, and can be detached from the image drum cartridge when the operating member does not operate said slidable member.

20. A developing apparatus, comprising:

a developing roller;

a developing blade having a first end portion at which said developing blade is fixedly supported and a second end portion at which said developing blade is movable to engage said developing roller; and a slidable member that slidably moves between an operative position and a non-operative position, wherein when said slidable member moves to the operative position, said slidable member urges the second end of said developing blade against said developing roller, and when said slidable member moves to the non-operative position, said slidable member does not urge the second end of said developing blade against said developing roller.

21. The developing apparatus according to claim 20, wherein said slidable member is caused to move between the operative position and the non-operative position by a cam mechanism.

22. The developing apparatus according to claim 20, further comprising an operating member that operates said slidable member to slide between the operative position and the non-operative position.

23. The developing apparatus according to claim 22, wherein the operating member is attached to an image drum cartridge when the operating member operates said slidable member and can be detached from said image drum cartridge when the operating member does not operate said slidable member.

* * * * *